US005839454A

United States Patent [19]

Matz

[11] Patent Number: 5,839,454

[45] Date of Patent: Nov. 24, 1998

[54] AUTOMATIC DETERGENT DISPENSER

[76] Inventor: Warren W. Matz, 13882 U.S. Hwy. 1, Juno Beach, Fla. 33408

[21] Appl. No.: 818,608

[22] Filed: Mar. 14, 1997

[51] Int. Cl.[6] ..... A47L 15/44

[52] U.S. Cl. ..... 134/57 D; 134/58 D; 134/99.2; 134/104.1; 134/113

[58] Field of Search ..... 134/56 D, 57 D, 134/58 D, 99.2, 104.1, 113; 68/12.18, 17 R; 222/651, 652

[56] References Cited

U.S. PATENT DOCUMENTS 3,370,597 2/1968 Fox ..... 134/58 R
3,749,288 7/1973 Wade ..... 222/187
4,147,559 4/1979 Fraula et al. ..... 134/99.2 X
4,218,264 8/1980 Federighi et al. ..... 134/99.2 X
5,282,901 2/1994 Reinhard ..... 134/57 D X

*Primary Examiner*—Philip R. Coe
*Attorney, Agent, or Firm*—McHale & Slavin

[57] ABSTRACT

The instant invention is an automatic detergent dispenser for residential dishwashers allowing transfer of liquid from a store purchased container or an integrated storage receptacle. The invention allows an individual to determine the amount of detergent to be transferred with provisions to operate the detergent transfer only upon demand preventing operation of the dishwasher if an insufficient amount of detergent is available. An alternative embodiment allows positioning of a storage container beneath the dishwasher chamber with provisions to fill the container.

19 Claims, 12 Drawing Sheets

AUTOMATIC DETERGENT DISPENSER

FIELD OF THE INVENTION

The instant invention relates to the field of dishwashers, and in particular, to a liquid detergent dispenser for automatically inserting a predetermined amount of detergent into a dishwasher.

BACKGROUND OF THE INVENTION

Dishwashers have become indispensable modern day appliances. The appliances eliminate the burden of washing and drying eating utensils by use of a chamber capable of automatically performing such tasks. A further advantage of the dishwasher is that the chamber provides a storage location for soiled eating utensils thereby economizing the washing process to provide the use of water and detergent efficiently.

As with any cleaning process, there exists a need for adding a detergent which acts as the mechanism for loosening embedded food particles. While conventional dishwashers include various mechanisms to dispense detergent at the proper time, a problem with such dishwashers is the inability to monitor and dispense an accurate amount for any particular dishwashing cycle. Some dispensers may employ markings to indicate to the homeowner the preferred amount of detergent before the washing cycle begins. These markings are hard to see, highly inaccurate, and nearly impossible to level off the detergent to the desired level marking. Most users therefore, fill the dispenser to the top and even overfill each time. When liquid detergent is used, it must be added right before the dishwashing cycle begins as liquid detergent has a tendency to leak out of the container causing interference with dispenser operation and lessening the effectiveness of the cleaning cycle. When granular detergent is used it must be added just before the dishwashing cycle begins, or the granular detergent tends to cake in the dispenser and does not thoroughly dissolve until sometime into the rinse cycle. Further, adding of detergent is easily forgotten when numerous members of a household are adding utensils to the dishwasher chamber. The individual who turns on the dishwasher may forget to add the necessary detergent thinking another performed the chore. In this situation the dishwasher goes through a complete cycle without any cleaning whatso-ever, only a rinsing. If the individual whose task it is to unload the dishwasher does not observe that the dishwasher went without detergent, but instead thinks that perhaps just some of the utensils did not come out very clean, the cooking utensils, dishes, etc. will be put away unclean and possibly even put away with harmful bacterial contamination on every item in the dishwasher.

Conventional detergent dispensers also present a problem most evident to those attempting to economically purchase liquid detergent in a bulk quantity. The lifting of a large volume container of fluid can cause injury to the elderly, small children, or the like individual who might be slightly physically impaired. The manual filling of door mounted dispensers requires the individual to balance the container while attempting to determine how much detergent should be placed within the dispenser.

The inefficiency also leads to a waste of detergent sending excess surfactants to discharge which inhibits both municipal and septic containers. In addition, excess detergent can damage glassware and fragile utensils as many liquid detergents have a high pH which is caustic. Liquid detergent may also contain sodium hypochlorite which is dangerous to store even temporarily especially in door-mounted dispensers and can burn infants or those people having tender skin. Thus, the amount of detergent used is critical to health, safety, operation, and the environment.

U.S. Pat. No. 3,370,597 discloses a dishwashing machine with a liquid sanitizer dispenser. The dispenser includes a motor driven pump and spray device incorporating a gravity fed pump with an integrated solenoid and dispensing valve. The main purpose of the device is to inject chlorine into the dishwasher for disinfection of the eating utensils. Cycling of the injection system is independent of the detergent dispensing cycle.

U.S. Pat. No. 3,749,288 discloses a liquid dispenser integrated into a wall of a dishwasher for inserting a wetting agent to assist the washing cycle.

U.S. Pat. No 5,282,901 discloses a removable liquid dispenser for inserting detergent into an industrial warewash machine. A probe is placed into the wash chamber for monitoring the conductivity of the wash water. The warewash chamber maintains a volume of water wherein the conductivity provides a relationship to water quality. The device is complicated and not suited for residential purposes, nor does it have the ability to monitor the amount of liquid detergent left in the supply container, or stop the machine from going through a wash cycle when there is no detergent available.

Thus, what is lacking in the art is a detergent dispenser that can be incorporated into a conventional dishwasher having the ability to automatically dispense liquid detergent from either an independent container or by use of an integrated reservoir, said dispenser including an ability to monitor the amount of detergent dispensed, the ability to monitor the amount of detergent left in the container before running out, and the ability to stop the machine from operating when there is no detergent available to be dispensed.

SUMMARY OF THE INVENTION

The instant invention discloses an apparatus for injecting detergent into a conventional residential dishwasher. In a preferred embodiment, the apparatus consists of an electric pump which operates on a timer used in conjunction with an existing dishwasher wherein the pump transfers liquid detergent from a container through the side wall of a dishwasher. The apparatus is energized/triggered by the same electrical impulse that triggers the currently used door-mounted detergent dispenser, thereby providing detergent at the proper time. The apparatus couples to the dishwasher water inlet solenoid which then allows transfer of fresh water to the dishwasher only when there is adequate detergent available to be dispensed. The apparatus includes a means for deenergizing the water inlet solenoid should the pump's sensing mechanism determine that an inadequate amount of detergent exists in the detergent container. The sensing mechanism and a suction tube is placed into an independent detergent container positioning both tubes along a bottom portion of the container for drawing of the detergent and monitoring its contents. An upper aperture provides venting of the container preventing collapse of the container as fluid is drawn.

The tubes are incorporated into a cap to simplify setting up the system allowing the cap to be easily exchanged for an existing cap. The tubes are placed into a container of liquid detergent by simply removing the packing cap and threading on the modified cap of the instant invention.

The pumping mechanism utilizes a timer allowing an individual to set the amount of detergent to be dispensed.

Predetermined settings allow an individual to quickly determine the amount of detergent to be dispensed. A self cleaning dispersion valve placed in the dishwasher prevents back flow of water to prevent diluting of the detergent and is self-cleaned during the wash cycle.

An alternate embodiment of the invention positions a storage container beneath the dishwasher allowing the consumer to internally fill the container. A benefit is the space saving feature and the ability to use low cost detergent packs. In addition, by providing a container with the instant invention, various liquid level monitoring mechanisms can be used.

In all embodiments, a sensor determines whether the liquid level within the container has fallen to a point that requires replenishment and alerts the user to this condition by use of a light and of an alarm mechanism. A solenoid trigger allows three additional wash cycles providing the homeowner with ample opportunity to replenish the detergent before it is completely exhausted. After the third wash cycle, the pumping mechanism's sensor discontinues the supply of electricity to the water inlet solenoid, thereby preventing the start of another wash cycle. When the user replenishes the supply of detergent, the pumping mechanism's sensor reconnects the electrical supply to the water inlet solenoid and normal dishwasher operation can resume. The instant invention allows for the modification of dishwasher design to include a detergent level monitor on the panel, as well as contemplates the operation of the pumping mechanism controls from the front panel of the dishwasher. It can be noted that the system also allows for the insertion of a small amount of detergent at the end of a cycle which acts as an air freshener.

Thus, an objective of the instant invention is to provide an automatic liquid detergent dispenser for use in combination with a new or existing dishwasher providing efficiency in detergent dispersion.

Another objective of the instant invention is to disclose an automatic detergent dispenser capable of utilizing existing liquid detergent storage containers.

Still another objective of the instant invention is to disclose a method of monitoring the level of liquid in a detergent container, including a means for detection of a low level condition providing both visual and audible indication of the level.

Yet still another objective of the instant invention is to provide additional wash cycles once a low liquid level is detected thereby allowing a homeowner sufficient time to replenish the detergent.

Yet still another objective of the instant invention is to incorporate a liquid detergent transfer pump together with a water inlet solenoid so as to provide a shut off of the water should an inadequate amount of detergent be available.

Yet still another objective of the instant invention is to position a detergent storage container in an open space beneath the dishwasher for optimum space use. Refilling of the container is accomplished by use of a side mounted access tube fluidly communicated with the storage container.

Yet another objective of the instant invention is to disclose a self-cleaning detergent fill, injection, and vents capable of maintaining a heightened level of moisture in the system to prevent detergent thickening.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the present invention is herein described in terms of a basic embodiment, it will be readily apparent to those skilled in this art that various modifications, rearrangements, and substitutions can be made without departing from the spirit of the invention. The scope of the present invention is thus only limited by the claims appended hereto.

Figure 1:
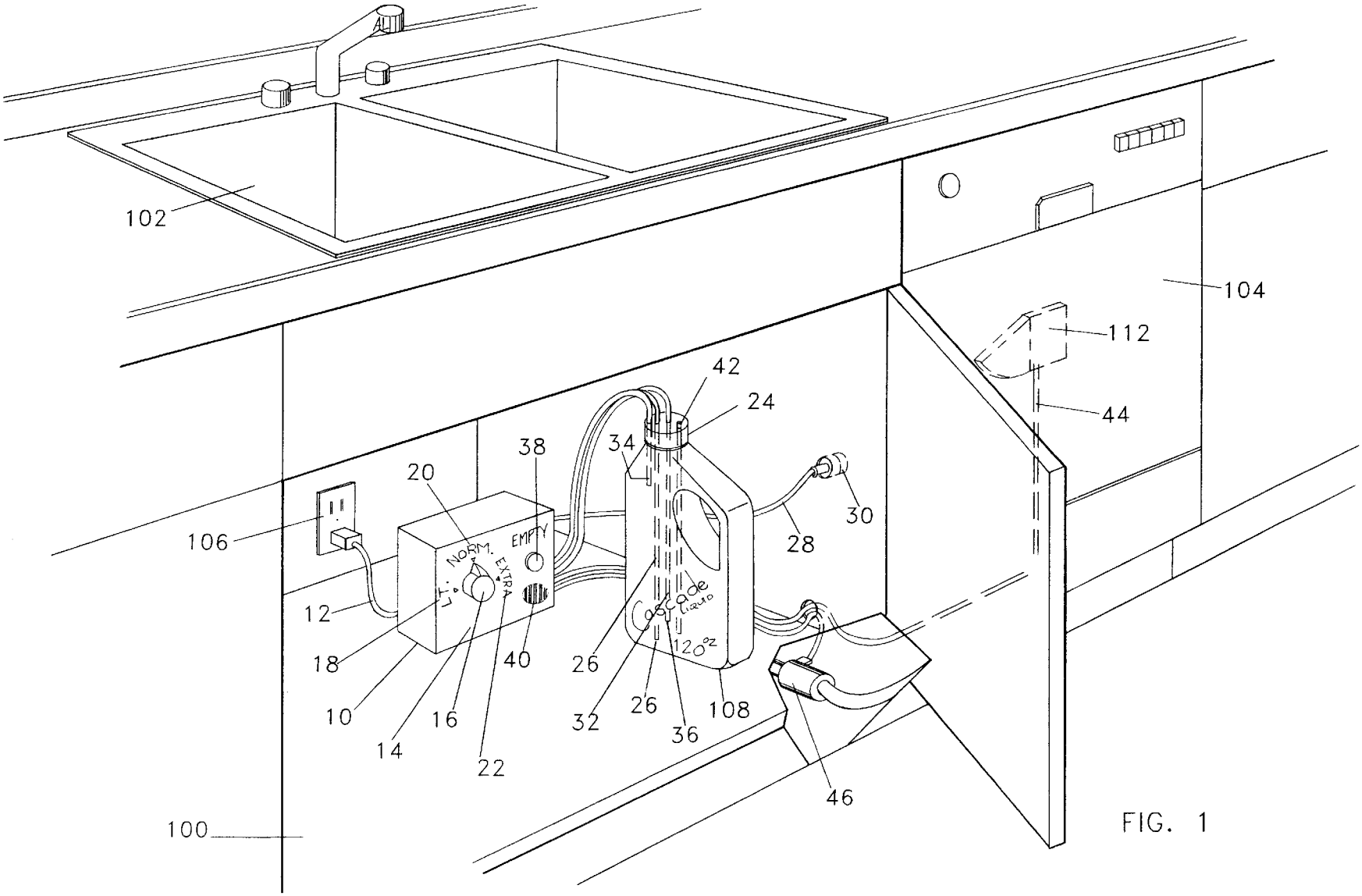
FIG. 1 is a pictorial view of the preferred embodiment of the instant invention drawing from a conventional liquid detergent container.

Now referring to FIG. 1, set forth is a pictorial view of a conventional residential kitchen depicting a cabinet 100 supporting a utility sink 102 adjacent to a dishwasher 104. The apparatus of the instant invention consists of a pump 10 that is operated on electricity as illustrated by electrical cord 12 inserted into wall socket 106, wherein the pump 10 is placed within a housing 14 having a timing mechanism such as a potentiometer or the like control switch 16 that permits the pump to run for a predetermined amount of time. A "light" setting 18 allows the pump to run at a minimal amount of time delivering only a small amount of detergent, perhaps ½ oz when regular water supply is "soft". A "normal" setting 20 allows the pump to operate a predetermined period of time to allow the pump to transfer an amount of liquid detergent into the dishwasher, perhaps the 1¼ A oz. typically required for an average dishwashing cycle and, an "extra" setting 22 provides pump operation leading to an additional amount of detergent transferred, perhaps 2 oz. for those instances where the dishwasher is expected to clean an oversized load, or when "hard" water conditions are present.

The transfer means is a pump 10 which is fluidly coupled to a liquid detergent storage means, capable of holding at least one pint of liquid, in this instance a container 108 wherein the shipping cap, not shown, is removed and replaced with a modified cap 24 having four apertures allowing detergent removal. A first aperture is coupled to tube 26 which is juxtapositioned a small distance from the bottom wall of the container 108 and allows for liquid detergent transfer through pump 10 outward through delivery tube 28 into injection fitting 30 mounted through the side wall of dishwasher 104. A second tube 32 allows liquid detergent transfer from container 108 through pump 10 and returns the detergent through return tube 34. This operation allows for continuous liquid sensing.

When the level of detergent drops beneath the entry opening 36 of the second tube 32, a sensor determines lack of fluid providing an alarm to indicate that the liquid container 106 is low on detergent. Alarm indication is provided by a light 38 located on the facade of the pump housing and having an audible alarm 40. Vent 42 is provided for aspiration to prevent collapse of the container while liquid detergent is being withdrawn.

The pump 10 is electrically coupled to the existing detergent drawer 112 of the dishwasher to initiate pump operation at a time predetermined by the manufacturer of the dishwasher. Water inlet solenoid 46 is electrically coupled to the liquid level sensing mechanism so that when a low level of liquid detergent is sensed, three additional washing cycles are allowed and then water inlet solenoid 46 is disconnected electrically thereby preventing any additional wash cycles until detergent is replenished.

Figure 2:
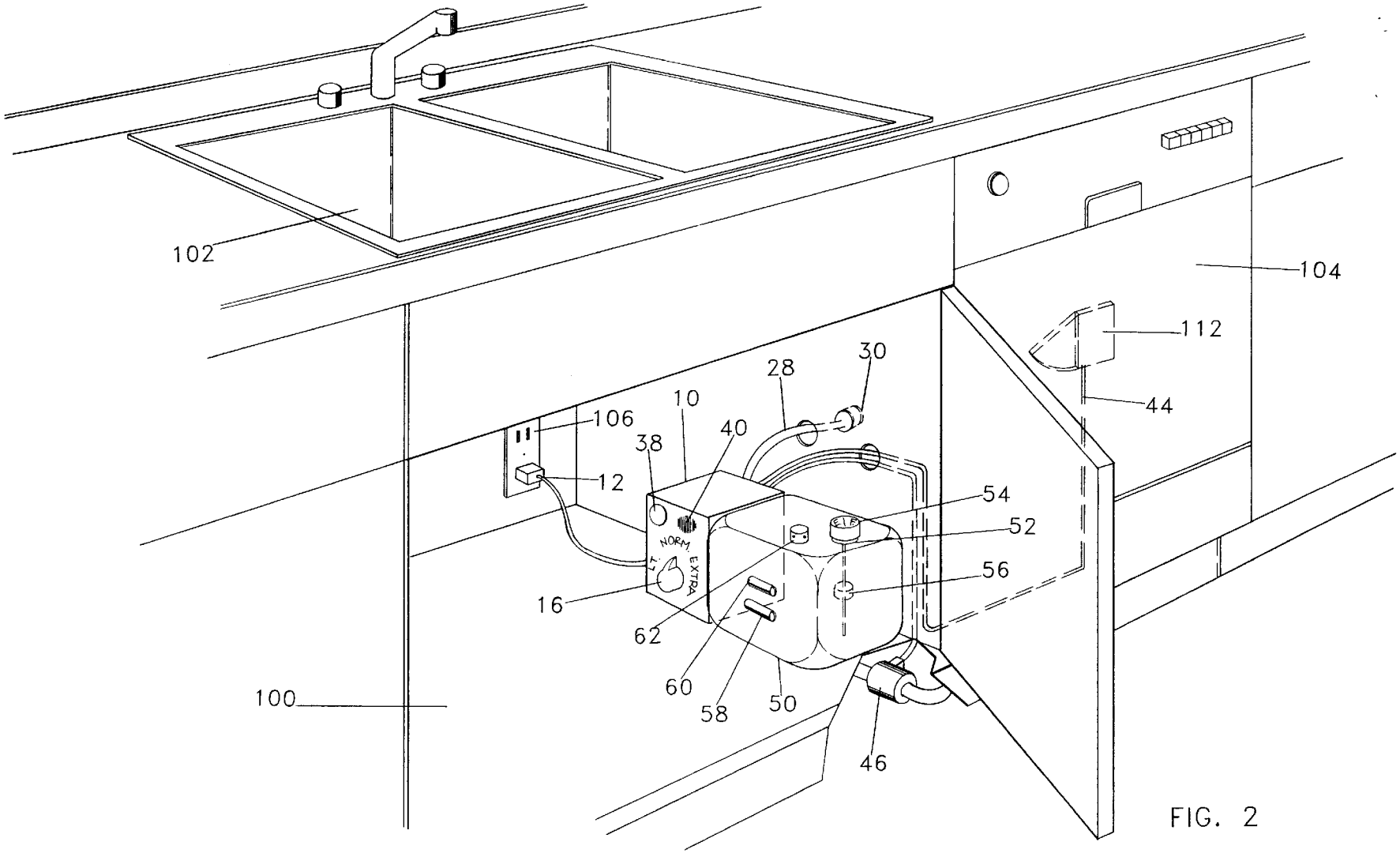
FIG. 2 is a pictorial view of an alternative embodiment having an integrated storage container.

Referring to FIG. 2, an alternative embodiment of the invention illustrates the pump 10 with the aforementioned control switch 16, coupled to a storage container 50. Pump 10 is operated on 120 VAC as provided by electrical cord 12 inserted into wall socket 106 having a DC step down transformer allowing direct pump control. In this embodiment the storage container 50 accepts a manual refill of detergent with a fill. port aperture 52 allowing insertion of liquid detergent. The fluid level is visually determined by indicator 54 which operates via a well known twist rod float 56 mechanism. It should be noted that the storage container 50 may be made of translucent material thereby eliminating the need for a visual float indicator as the level may be determined by viewing through the side wall of the storage container 50.

Operation of this embodiment remains similar to the previous embodiment by positioning the apparatus within an open cabinet 100 next to a dishwasher 104. The operation of the pump 10 is initiated by detergent drawer 112 electrically coupled by cable 44 to the pump controller mechanism. In addition, inlet solenoid 46 is electrically coupled to the apparatus providing a delayed shut off of water if an insufficient amount of detergent exists within the storage container 50.

In operation, suction tube 58 is juxtapositioned along bottom wall of storage container 50 providing an inlet for the pumping mechanism with outlet tube 28 coupled to injection fitting 30 placed through the side wall of dishwasher 104. A tube opening 60 assists in determining the fluid level within the container by providing an indicator to the pump 10 when the level of liquid detergent falls below the aperture opening. As with the previous embodiment, inadequate fluid level operates light 38 and audible alarm 40 so as to provide an indication to the homeowner of a low level condition. In addition, as previously mentioned, the apparatus provides approximately three additional dishwasher cycles once the liquid has fallen below tube opening 60 before disengaging inlet solenoid 46. It will be obvious to one of ordinary skill in the art that the amount of dishwashing cycles after the fluid falls beneath the low level pick up may be adjusted in accordance with the size and shape of the liquid detergent container and the detergent setting, i.e., LT.—NOR.—EXTRA. Vent 62, described later in the specification, prevents collapse of the storage container 50 as the pump 10 draws detergent from the chamber.

Figure 3:
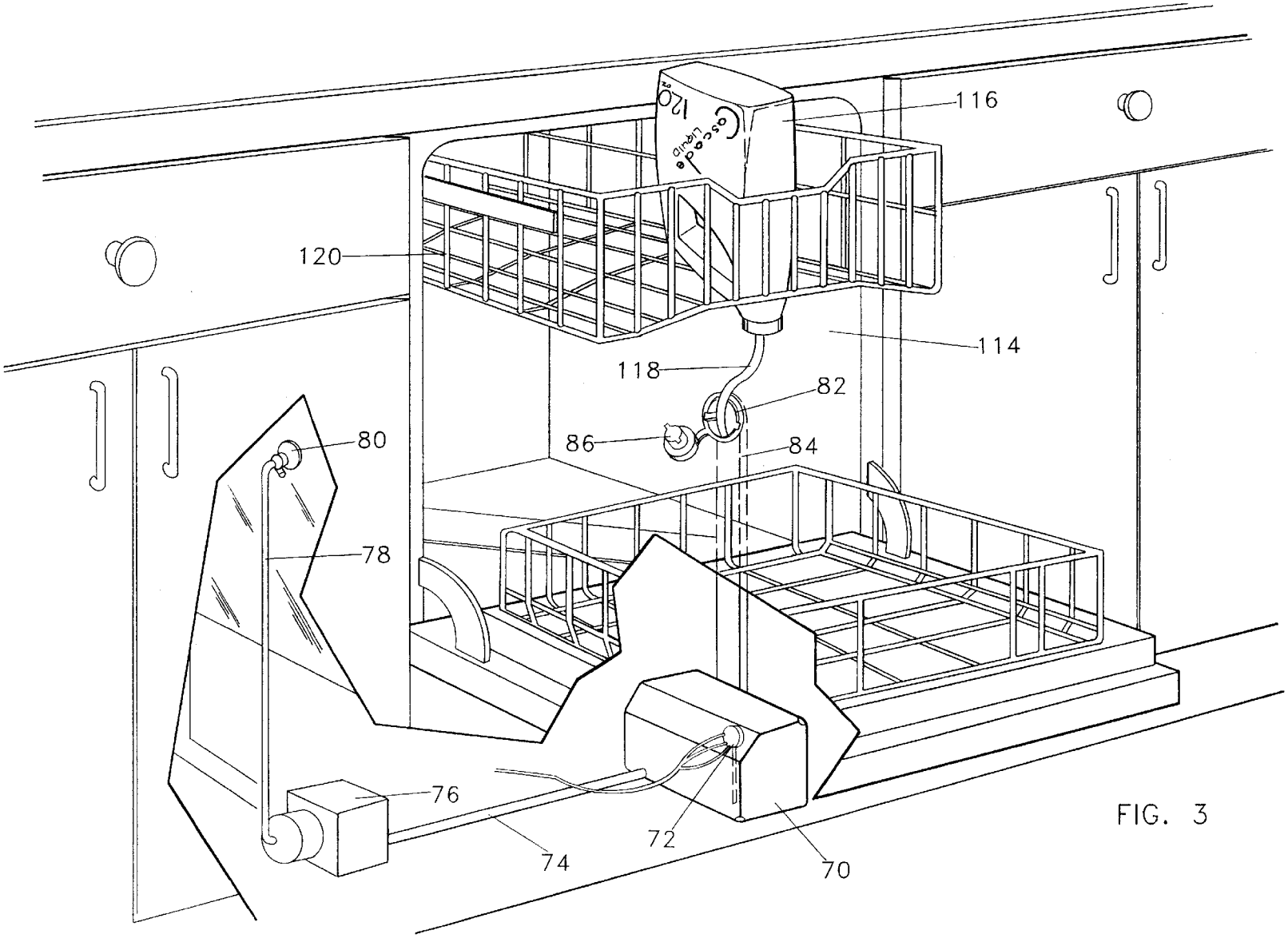
FIG. 3 is a pictorial view of an embodiment employing a remote storage container.
Figure 4:
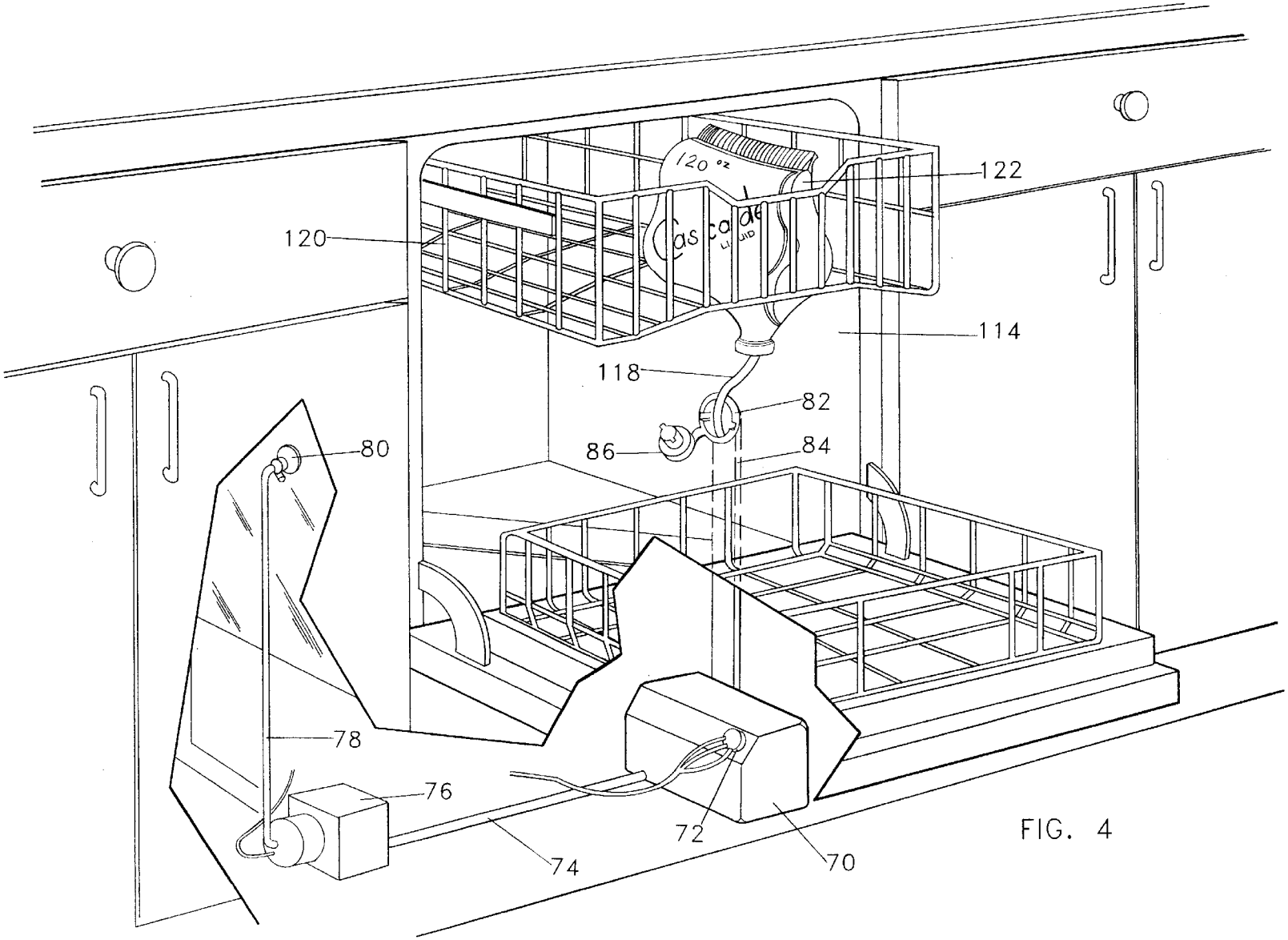
FIG. 4 is a pictorial view of a remote storage container being filled from a soft walled liquid dispenser.

Now referring to FIGS. 3 and 4, set forth is an alternative embodiment of the instant invention having a container 70 remotely located beneath dishwasher chamber 114. An alternative sensing mechanism 72 may consist of an electrode for detecting the level of liquid within the container 70. Suction tube 74 is fluidly coupled to pump 76 which transfers liquid through dispensing tube 78 into dispensing mechanism 80 placed in the side wall of the dishwasher chamber 114. Filling of the container 70 is provided by aperture 82 having connecting pipe 84 fluidly communicating with an upper portion of container 70.

Detergent container 116 may be temporarily placed on the upper rack 120 with a fill tube 118 placed into aperture 82 allowing transfer of its contents into container 70. As will be described later in this specification, aperture cap 86 is of a design to engage aperture 82 for sealing of connecting pipe 84, yet providing a means for a moisture rich environment to be maintained in container 70 to prevent thickening of the detergent. FIG. 4 is identical to FIG. 3 with the exception of pictorial illustration of a flexible dispenser 122. This allows a cost savings to the homeowner by elimination of a heavy detergent container 116 as the flexible dispenser 122 is used only for a quick transfer, not storage, of the detergent into the container 70 before disposal.

Figure 5:
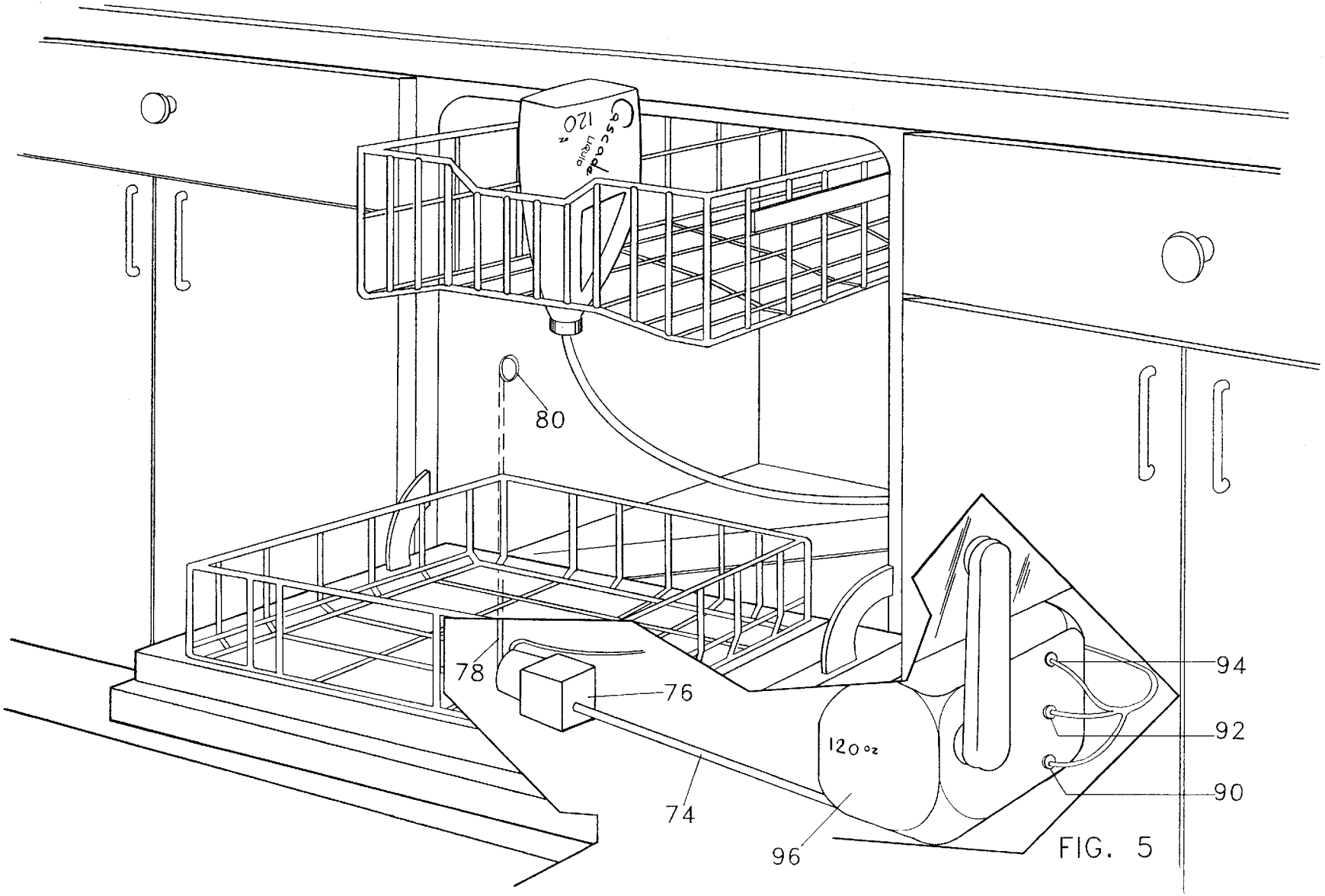
FIG. 5 is a pictorial view of an embodiment having a remote storage container with multiple sensors.

Now referring to FIG. 5, set forth is a variation of the integrated storage container having three electrodes indicating either empty 90, ½ full 92 and full 94 fluid levels. As with the previous embodiments, transfer tube 74 is coupled to transfer pump 76 which engages dispensing tube 78 for subsequent insertion through the side wall of the dishwasher.

Figure 6:
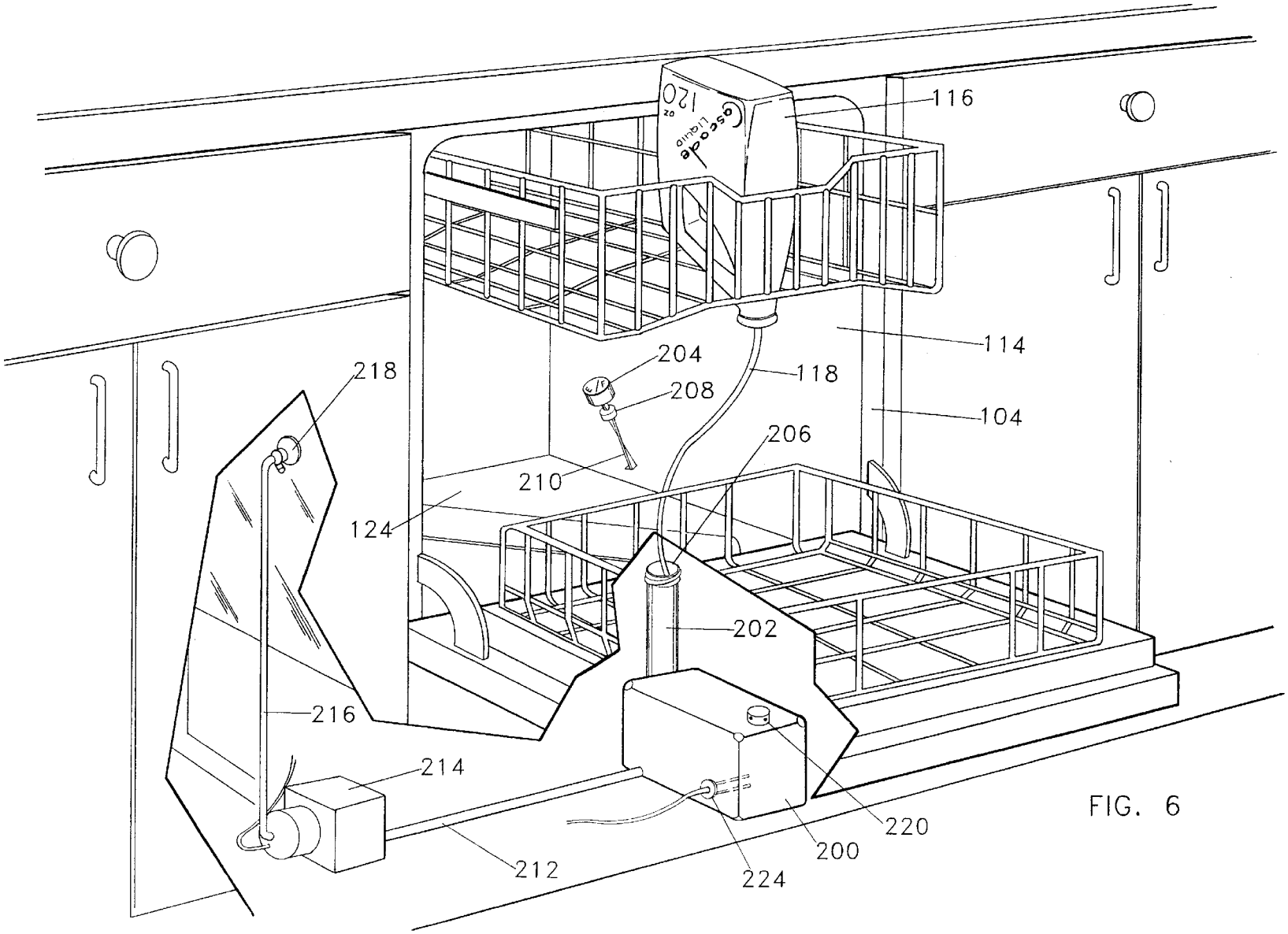
FIG. 6 is a pictorial view of a mechanical liquid level indicator used in conjunction with a sensing mechanism in a remote storage container.

Now referring to FIG. 6, container 200 is illustrated beneath dishwasher 104 having fill port 202 positioned along dishwasher chamber floor 124 wherein the previously described mechanical visual indicator 204 threadingly engages opening 206 of the fill port 202. Visual indicator 204 includes a floating mechanism 208 placed along twist rod 210 providing a rotational movement to an indicator in relation to the amount of rod twist. As with the previous embodiment, liquid detergent is transferred via suction tube 212 coupled to transfer pump 214 for delivering fluid through tube 216 and into the dishwasher chamber 114 via dispensing mechanism 218. Vent 220 is located along the upper portion of container 200 allowing the visual indicator 204 to tightly seal the container to prevent water from entering the fill port during the dishwasher cycle. In this manner, liquid detergent is delivered through fill tube 118 into the opening 206. Low level determination is performed by sensing mechanism 224 which operates along the previously described principles of a sensing electrode.

Figure 8:
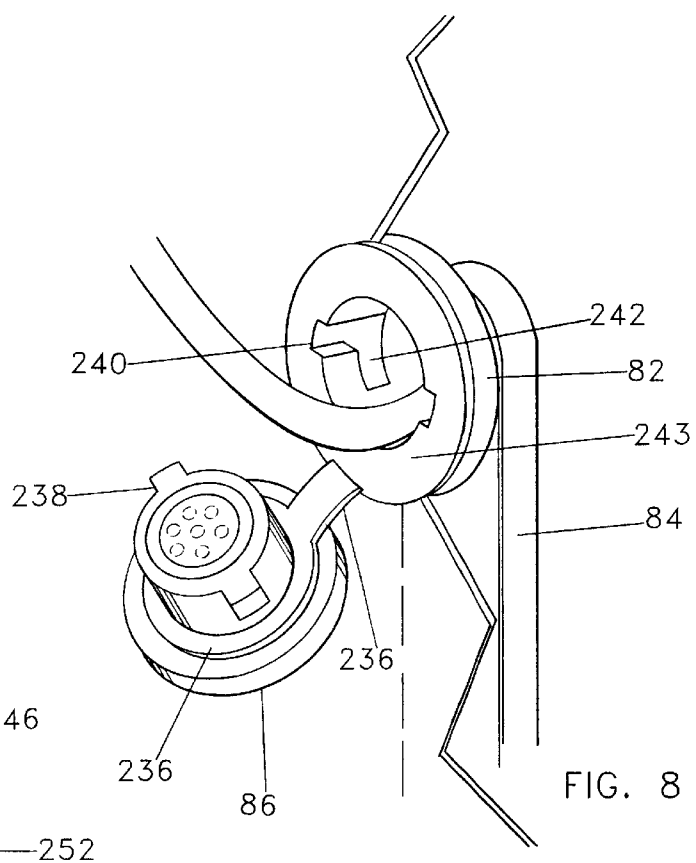
FIG. 8 is a perspective view of the fill port shown in FIG. 7 in an open position and a fill tube positioned therein.
Figure 9:
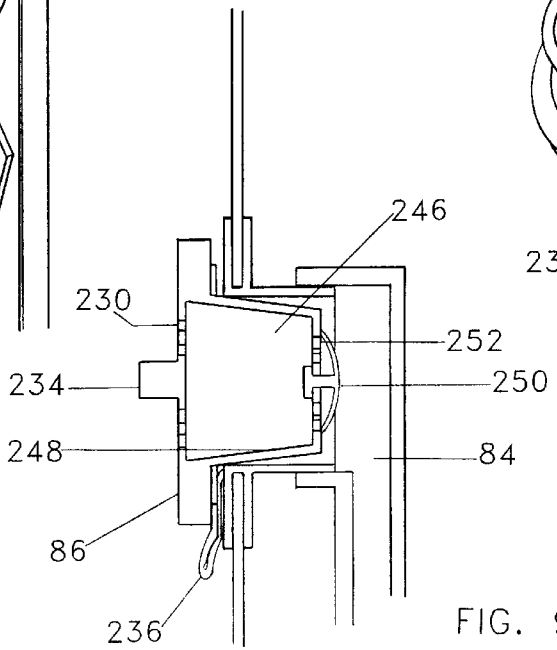
FIG. 9 is a cross-sectional side view of FIG. 7.
Figure 7:
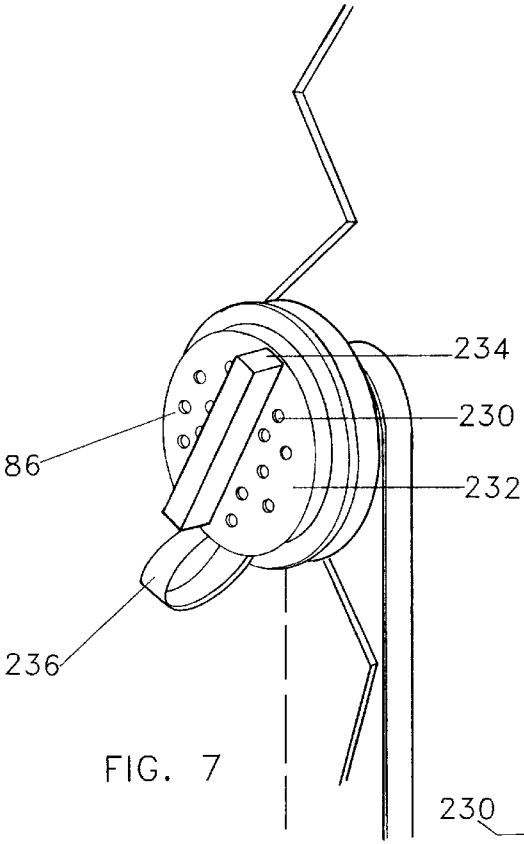
FIG. 7 is a perspective view of a side wall fill port.

FIGS. 7 through 9, set forth the aperture cap 86, as previously described, which is used for coupling to aperture 82 having connecting pipe 84 secured to a storage container located beneath the dishwasher chamber. The aperture cap 86 includes a plurality of venting holes 230 positioned on an outer surface 232 of the cap with a raised ridge 234 allowing for ease of twisting the cap for insertion and removal. Flexible gasket 236 prevents misplacement of the cap while opened. The cap has inner coupling tabs 238 which fit within slot 240 with a twist lock section 242 for securing the cap in position. It is noted that the gasket 236 forms around the inner surface of the cap for sealing against wall member 243. As noted in FIG. 9, aperture cap 86 shown in a sealed position wherein gasket 236 provides a seal with excess moisture drained by sloping surface 248 through aforementioned venting holes 230. A venting check valve is formed by flexible member 250 positioned along a rear portion of aperture cap 86 having a plurality of venting holes 252 which allows a small amount of moisture to bleed into connecting pipe 84 to help maintain a high moisture level thereby preventing thickening of the liquid detergent.

Figure 11:
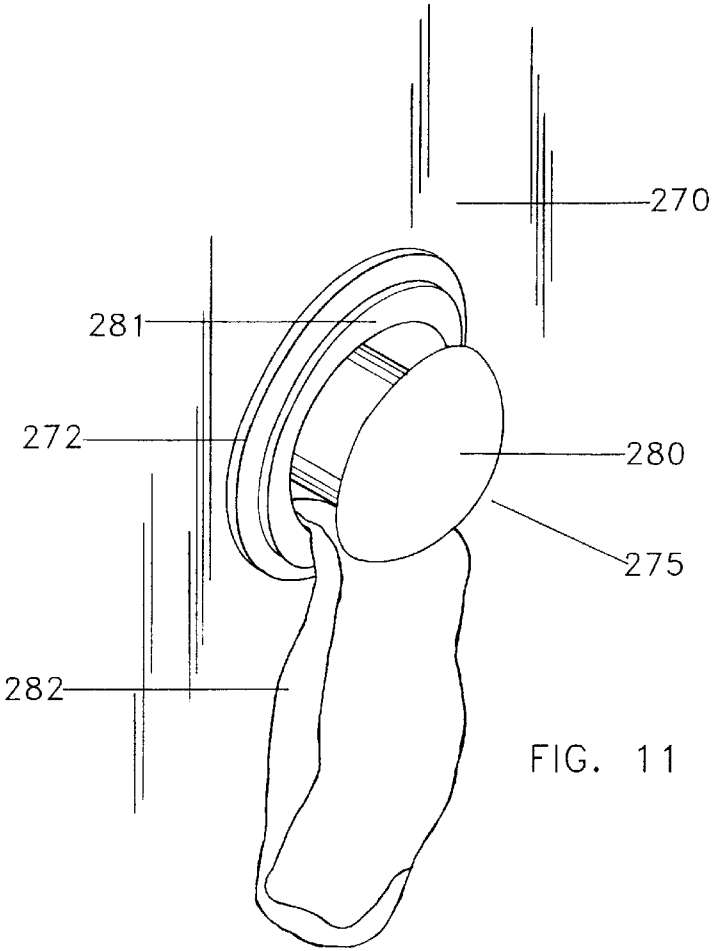
FIG. 11 is a pictorial view of FIG. 10 illustrating detergent delivery.
Figure 10:
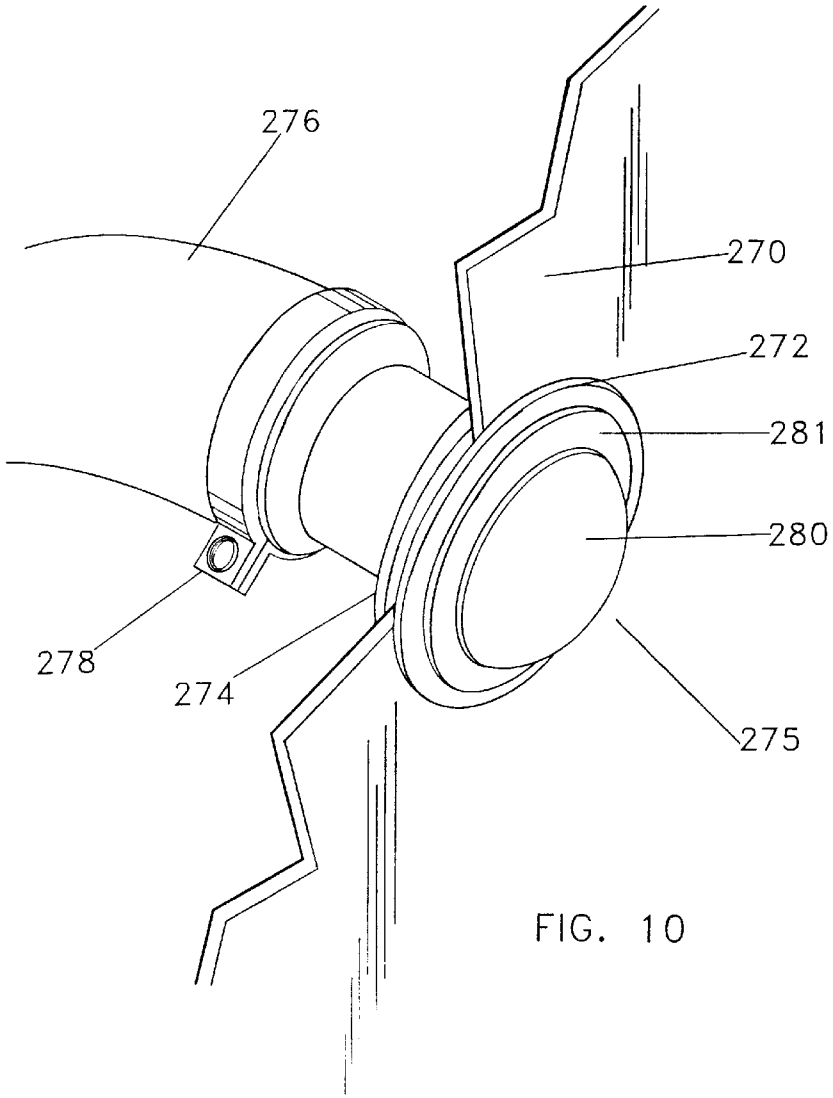
FIG. 10 is a perspective view of the liquid dispenser delivery mechanism.
Figure 13:
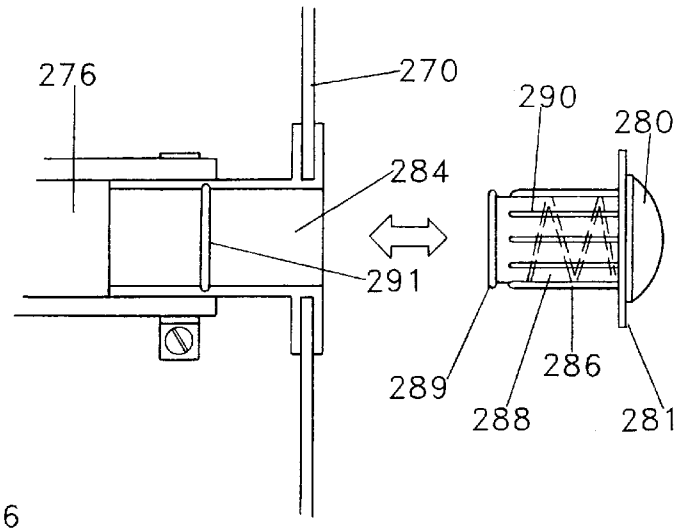
FIG. 13 is a cross-sectional side view of FIG. 12.
Figure 12:
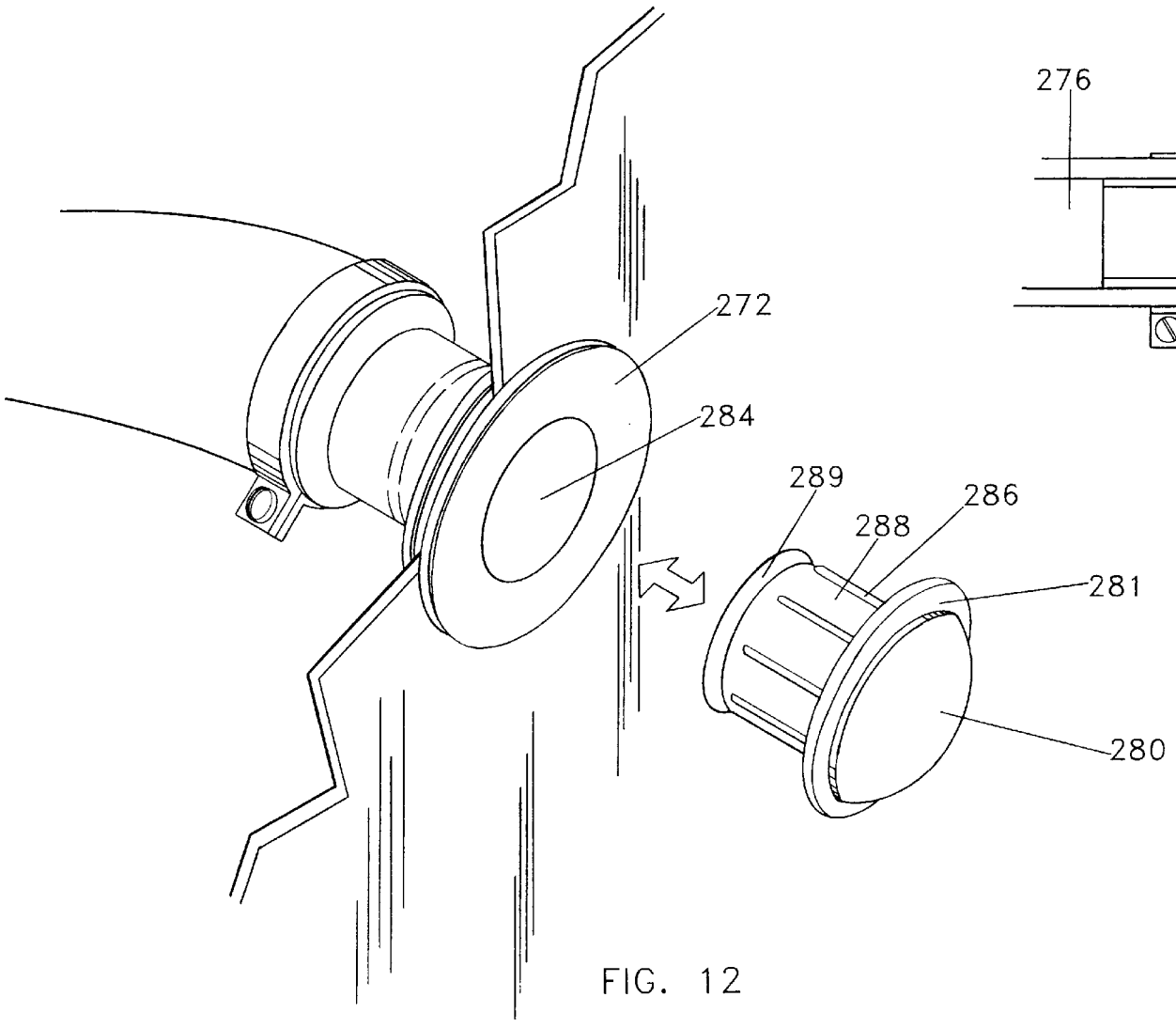
FIG. 12 is an exploded view of FIG. 10.

Now referring to FIGS. 10 through 13, set forth is the liquid injection dispenser member 275 mounted on a side wall 270 of a dishwasher having an inner lip 272 and an outer lip 274 engaging the dishwasher side wall 270 therebetween. Tube 276 is secured to the liquid injection dispenser member 275 by a coupling mechanism 278. As shown in FIG. 10, the liquid injection dispenser member 275 is in a closed position with cap 280 set in position by placement against cap seat 281 of inner lip 272. In FIG. 11, cap 280 of liquid injection dispenser member 275 is opened, the distance allowing the dispensing of detergent 282 to enter into the dishwasher chamber. Cap 280, as further illustrated by FIG. 12 is removable from chamber 284 allowing ease of cleaning or replacement if required. The cap 280 and spring 290 are housed in insertion fitting 286 and are held in place by a compression fit between a raised groove 289 on insertion fitting 286 and a recessed groove 291 on chamber 284. A plurality of raised ridges 288 along the surface of the insertion fitting 286 eases the removal and replacement thereof. Spring 290 is located within the cap 280 causing the cap to be drawn to a tight seal against cap seat 281 when no fluid is being dispensed through tube 276. It is noted that while dispensing of liquid detergent is taking place, it is performed during a cycle wherein the inlet solenoid is allowing water into the dishwasher chamber, thereby the displacement of the cap 280 allows for continually rinsing of the dispensing mechanism while detergent is being delivered and, after the deliverance, the washing water provides a removal of detergent from surfaces of cap 280 and cap seat 281 so as to eliminate the sticking of cap 280 upon closure.

Figure 15:
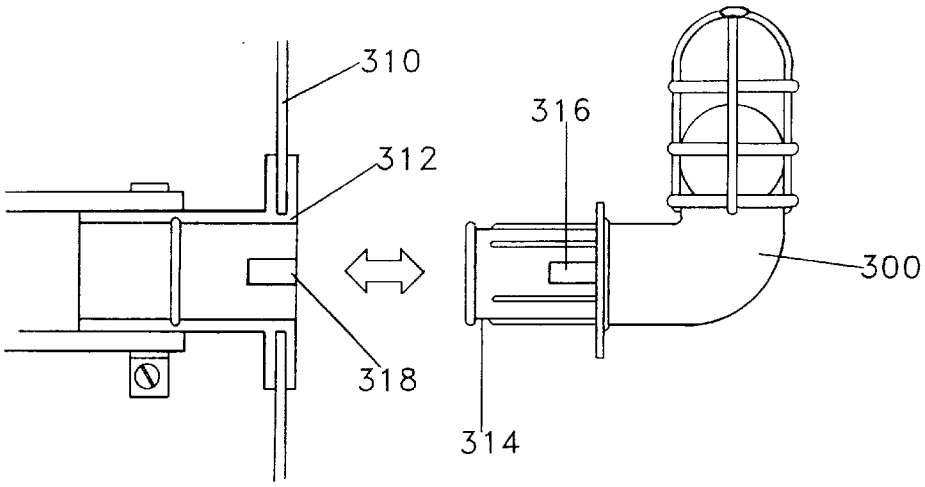
FIG. 15 is a cross-sectional side view of FIG. 14.
Figure 14:
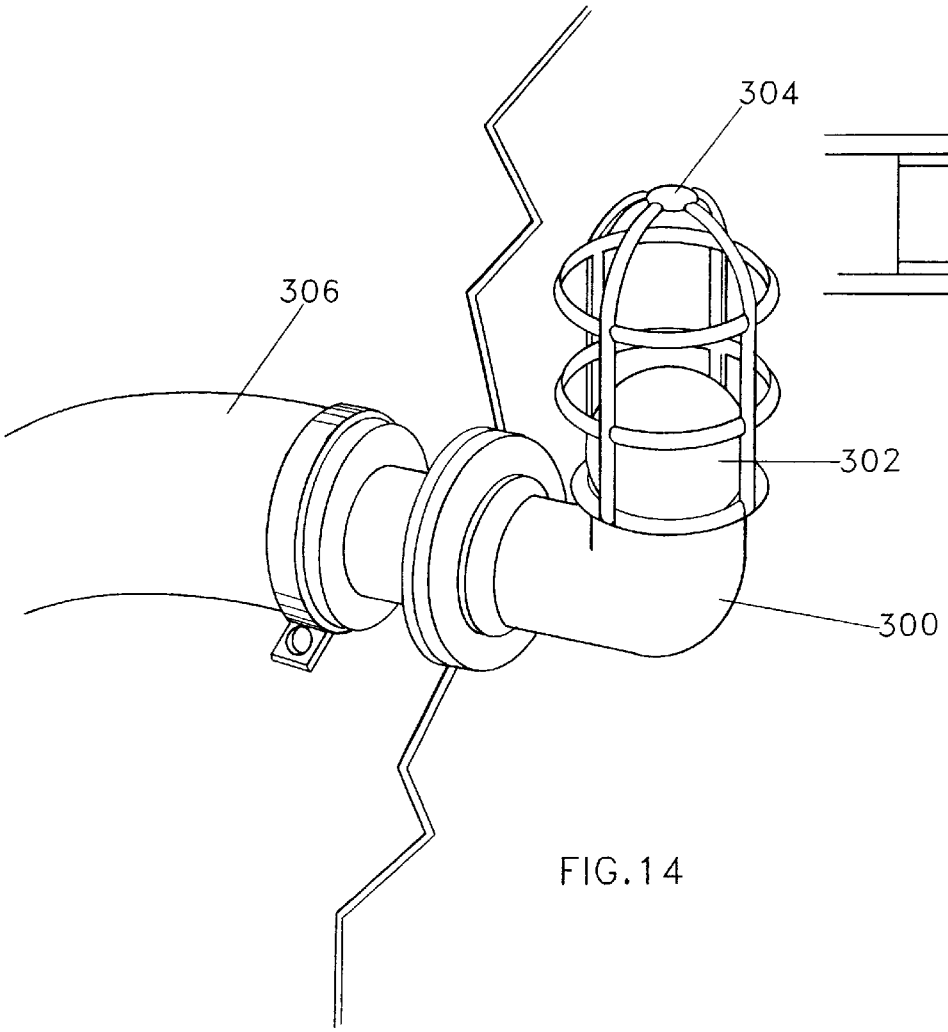
FIG. 14 is a perspective view of an alternative embodiment for detergent dispensing.

Referring to FIGS. 14 and 15, set forth is yet another embodiment of a liquid dispenser member having an elbow 300 with a float ball 302 placed within floatable cage 304 which allows detergent to carry through dispensing tube 306 forcing float ball 302 upward until the deliverance of detergent stops float ball 302 is resituated to prevent water from entering elbow 300. It should be noted that a small amount of water entering elbow 300 is deemed beneficial as it provides additional moisture to the storage container which helps to prevent solidification of the detergent. As shown in FIG. 15, the elbow 300 can be easily removed for repair, cleaning, or replacement wherein housing 312 is operatively associated with inlet section 314 having locking tabs 316 which engage locking slots 318 of housing 312.

Figure 17:
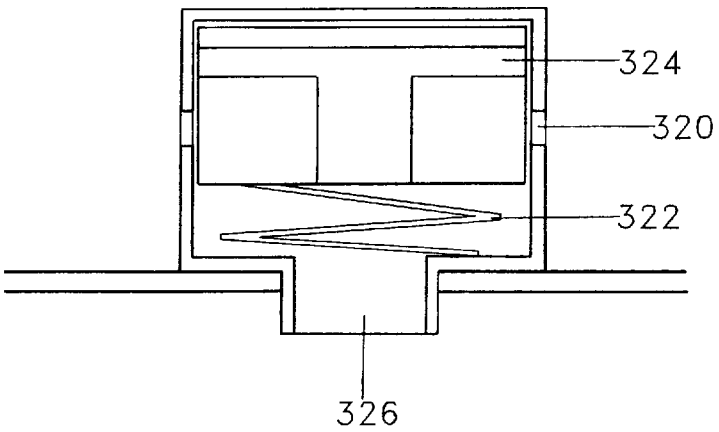
FIG. 17 is a cross-sectional side view of FIG. 16 with the vent shown in a closed position.
Figure 18:
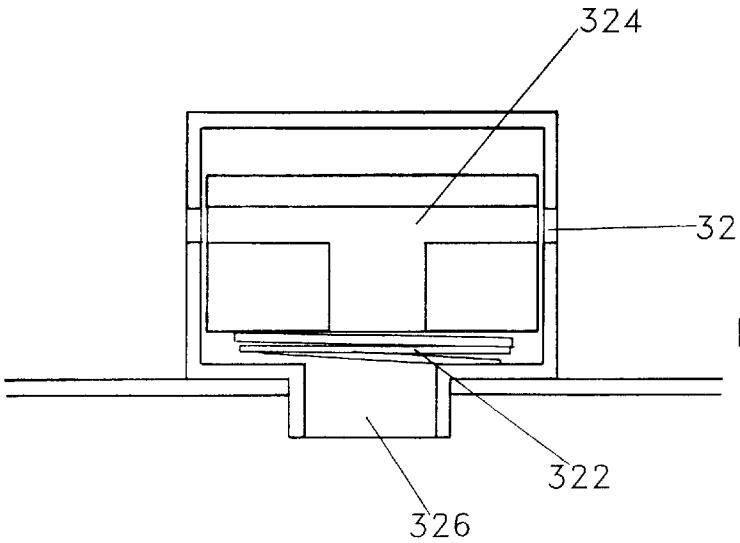
FIG. 18 is a cross-sectional side view of FIG. 16 with the vent shown in an open position.
Figure 16:
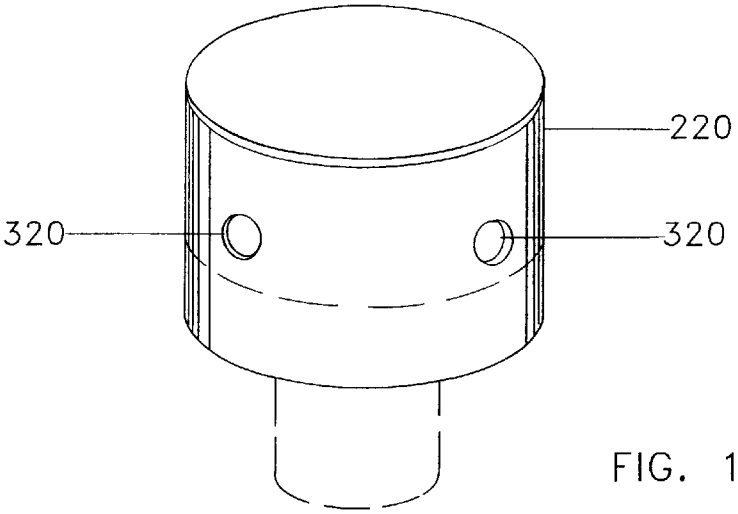
FIG. 16 is a perspective view of the liquid detergent container vent.

Now referring to FIGS. 16 through 18, the vent 220 includes a plurality of openings 320 which allow air to be drawn into the housing. Spring 322 is forced into a closed position by suction caused upon the transfer of liquid from the vented container. When sufficient air has displaced liquid within the vented container, openings 320 are disjoined from chamber 324 by the upward movement of chamber 324 providing a check valve type operation to inhibit additional air from entering the container.

Figure 19:
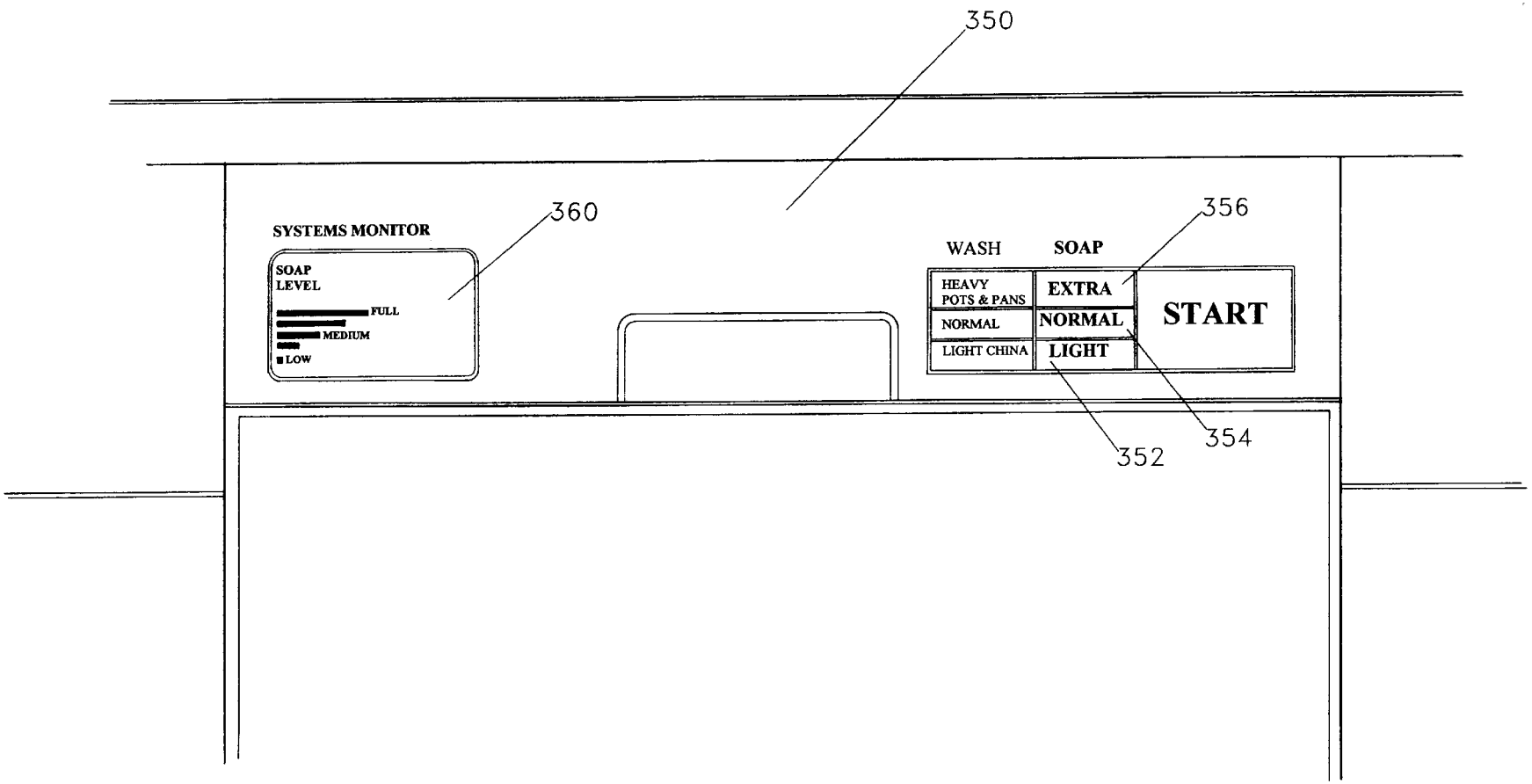
FIG. 19 is a front view of dishwasher control panel incorporating pump controls on the facade of the dishwasher panel, and a systems monitor to indicate detergent level.

As shown in FIG. 19, a pictorial of a dishwasher 350 having the controls integrated directly into the control panel is shown and made possible by the second embodiment of this invention wherein the homeowner may depress a light 352, normal 354, or extra heavy setting 356, as dependent upon the types of eating utensils to be washed, and hardness of water supply. As noted, next to each section is an illustration of the need for a light amount of detergent for china versus an extra heavy amount of detergent which is used for pots and pans. A systems monitor 360 is provided which allows a reading of the amount of detergent within the container providing a graphic illustration of a low, medium, or full amount of detergent.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. In combination with a dishwasher having a washing chamber and internal spray mechanism operated by water flowing through an electrically actuated inlet solenoid for cleansing of utensils placed within the chamber having detergent released through the use of a chamber mounted dispenser mechanism, an automatic detergent dispenser comprising: storage means for holding a large volume of liquid detergent; transfer means fluidly coupling said storage means to said washing chamber; and a control means electrically coupling said transfer means to said inlet solenoid and said chamber mounted dispenser mechanism;

whereby said storage means is located external said chamber wherein liquid detergent is drawn from said storage means by said transfer means upon initiation of said chamber mounted dispenser mechanism if said inlet solenoid is actuated.

2. The combination according to claim 1 wherein said storage means is defined as a container capable of holding at least one quart of detergent.

3. The combination according to claim 2 wherein said container is a shipping bottle for liquid detergent.

4. The combination according to claim 1 wherein said transfer means is defined as an electrically operated pump, said pump having an inlet fluidly coupled to said storage means for drawing of detergent and an outlet fluidly coupled to said washing chamber for transferring of detergent to said chamber.

5. The combination according to claim 4 wherein said transfer pump includes a DC operated motor.

6. The combination according to claim 4 wherein said control means includes a timer to control the amount of time the transfer pump operates wherein setting of the timer allows an individual to predict the amount of liquid detergent to be transferred.

7. The combination according to claim 6 wherein said timer is manually adjustable.

8. The combination according to claim 1 wherein said control means includes a sensor for monitoring the level of liquid detergent in said storage means, said sensor closing the inlet solenoid and initiating an alarm sequence upon the detection of a low level of liquid.

9. The combination according to claim 8, wherein said sensor closes the inlet solenoid once triggered by a low level condition after a predetermined number of washing cycles.

10. The combination according to claim 1 wherein said storage means includes a cap adaptable to said storage means for securing a detergent suction tube, sensor tube, return tube and a venting tube.

11. In combination with a dishwasher having a washing chamber and internal spray mechanism operated by water flowing through an electrically actuated inlet solenoid for cleansing of utensils placed within the chamber having detergent released through the use of a chamber mounted dispenser mechanism, an automatic detergent dispenser comprising: storage means capable of holding at least one quart of detergent; a transfer means having an inlet tube fluidly coupled to said storage means for drawing of detergent and an outlet tube fluidly coupled to said washing chamber for transferring of detergent to said chamber; and a control means having a timer electrically coupling said transfer means to said inlet solenoid and said chamber mounted dispenser mechanism;

whereby said storage means is located external said chamber wherein liquid detergent is drawn from said storage means by said transfer means upon initiation of said chamber mounted dispenser mechanism if said inlet solenoid is actuated.

12. The combination according to claim 11 wherein said control means includes a sensor for monitoring the level of liquid detergent in said storage means, said sensor closing the inlet solenoid and initiating an alarm sequence upon the detection of a low level of liquid.

13. The combination according to claim 12 wherein said sensor closes the inlet solenoid once triggered by a low level condition after a predetermined number of washing cycles.

14. The combination according to claim 12 wherein said alarm sequence includes a visual and audible indicator.

15. The combination according to claim 11 wherein said storage means includes a means for venting.

16. The combination according to claim 11 wherein said storage means includes a remote fill tube having an inlet opening secured through a wall of said wash chamber, said inlet opening having a cap releaseably engagable with said inlet opening.

17. The combination according to claim 16 wherein said cap has a cone shaped body member having a front wall a positioned a fixed distance from a rear wall forming a chamber therebetween with said cone shape allowing accumulated water to drain into the wash chamber, said rear wall having a plurality of openings with a flexible member coupled thereto providing a venting seal to said inlet opening.

18. The combination according to claim 11 wherein said outlet tube includes a self cleaning injection fitting means secured to a side wall of said wash chamber.

19. In combination with a dishwasher having a washing chamber and internal spray mechanism operated by water flowing through an electrically actuated inlet solenoid for cleansing of utensils placed within the chamber having detergent released through the use of a chamber mounted dispenser mechanism, an automatic detergent dispenser comprising: a remotely located storage means capable of holding at least one quart of detergent, said storage means having a vented fill tube; a transfer means having an inlet tube fluidly coupled to said storage means for drawing of detergent and an outlet tube fluidly coupled to said washing chamber for transferring of detergent to said chamber, said outlet tube coupled to a self cleaning injection fitting; a control means having a timer electrically coupling said transfer means to said inlet solenoid and said chamber mounted dispenser mechanism; and a sensor means for monitoring the level of liquid detergent in said storage means, said sensor closing the inlet solenoid and initiating an alarm sequence upon the detection of a low level of liquid;

whereby said storage means is located external said chamber wherein liquid detergent is drawn from said storage means by said transfer means upon initiation of said chamber mounted dispenser mechanism if said inlet solenoid is actuated.

* * * * *